US007096631B1

(12) United States Patent
Counihan

(10) Patent No.: US 7,096,631 B1
(45) Date of Patent: Aug. 29, 2006

(54) RESILIENT FLOORING

(76) Inventor: James Counihan, 50 Griffin Mill Rd., Piedmont, SC (US) 29673

( * ) Notice: Subject to any disclaimer, the term of this patent is extended or adjusted under 35 U.S.C. 154(b) by 245 days.

(21) Appl. No.: 10/870,620

(22) Filed: Jun. 17, 2004

(51) Int. Cl.
*E04F 15/22* (2006.01)

(52) U.S. Cl. ..... 52/403.1; 52/480; 52/506.1; 52/506.05

(58) Field of Classification Search ..... 52/403.1, 52/408, 506.01, 506.05, 747.1, 747.11, 480, 52/582.1, 483.1, 489.1, 508, 509, 510, 512
See application file for complete search history.

(56) References Cited

U.S. PATENT DOCUMENTS

| | | | | |
|---|---|---|---|---|
| 274,354 | A * | 3/1883 | McCarthy et al. | 52/591.4 |
| 3,436,888 | A | 4/1969 | Ottosson | |
| 5,016,413 | A | 5/1991 | Counihan | |
| 5,299,401 | A | 4/1994 | Shelton | |
| 5,377,471 | A | 1/1995 | Niese | |
| 5,497,590 | A | 3/1996 | Counihan | |
| 5,609,000 | A * | 3/1997 | Niese | 52/480 |
| 5,647,183 | A * | 7/1997 | Counihan | 52/403.1 |
| 5,906,082 | A | 5/1999 | Counihan | |
| 6,073,409 | A * | 6/2000 | Chambers | 52/403.1 |
| 6,122,873 | A * | 9/2000 | Randjelovic | 52/403.1 |
| 6,397,543 | B1 | 6/2002 | Hamar | |
| 6,688,065 | B1 * | 2/2004 | Chambers | 52/480 |

* cited by examiner

*Primary Examiner*—Lanna Mai
*Assistant Examiner*—Paul Devoti
(74) *Attorney, Agent, or Firm*—McNair Law Firm, P.A.

(57) ABSTRACT

A resilient flooring system in combination with an athletic court having a playing direction and a cross-direction transverse of said playing direction. The flooring system comprises a non-resilient base covered with a resilient layer, and sub-flooring comprising substantially rectangular panel members laid side-by-side and end-to-end in staggered relationship diagonally of the playing direction. The panels are slightly spaced along their ends and sides to form expansion joints. Flooring shorts are arranged over the sub-floor in end-to-end and side-to-side engagement. The shorts are arranged to extend parallel with the playing direction over the entire length of the court. The shorts are also arranged so that a section thereof between opposed ends extends over the expansion joints. Securing members secure each short with the panel members on opposing sides of the expansion slots. Finally, clips are provided to secure the panel members with the base flooring in a manner allowing limited vertical movement.

13 Claims, 3 Drawing Sheets

RESILIENT FLOORING

BACKGROUND OF THE INVENTION

The invention relates to a surface resilient flooring system primarily for use as flooring for athletic venues and constructed over non-resilient base fibors. The invention also relates to a resilient flooring system which utilizes a plurality of floor covering layers.

Various resilient flooring arrangements are known in the industry as illustrated by U.S. Pat. Nos. 5,016,413, 5,497,590 and 5,906,082. None of these patents recognize the component relationships herein called for.

It is a primary object of the instant invention to provide a resilient flooring system for athletic events which present an uniformally resilient surface area throughout.

It is another object of the instant invention to provide a resilient flooring for athletic events which present no dead spots.

It is another object of the invention to present a resilient flooring system which is easily installed.

SUMMARY OF THE INVENTION

The instant invention is directed to a resilient flooring system for use in athletic facilities as flooring for game courts. The system is sturdy, provides uniform resiliency and relatively easy to install.

The flooring system is multi-layered comprising a base surface which is non-resilient and usually formed of concrete. A vapor lock, usually comprising a synthetic sheet is positioned over the base surface to control moisture. The vapor lock preferably comprises polyethylene sheeting although other synthetic materials or even spray coatings may be employed.

A resilient layer is laid over the vapor lock and base layer. Preferably the resilient layer comprises ¼"×2"×2" rubber panels laid side-by-side and end-to-end on 12" centers provide the resilient layer. Other materials such as synthetic foam sheets may also suffice. The width and size of the panels may also vary as desired.

Sub-floor panels, which preferably comprise 2'×8'×¾" plywood sheeting, are positioned over the resilient layers in side-by-side and end-to-end relationship. The plywood panels are on center of the adjacent panels with a ¼" gap provided between the adjacent ends and sides.

Prior to laying the panels on the base floor, the longitudinal direction of the court must be determined so that the panels may be laid diagonally of the longitudinal direction of the court.

Pockets are formed on each side of the panels at equally spaced positions. The pockets on a first side are upwardly directed pockets while the pockets on the second side are downwardly directed pockets. When positioned over the resilient layer covering the base floor an upwardly directed pocket is directly opposite a downwardly directed pocket.

Beneath the downwardly directed pocket there is a cutout formed in the resilient layer. A Z-shaped clip is provided for holding the panels in position. A longitudinal extension of the clip is secured in the cutout directly with the concrete while the other longitudinal extension is positioned in the upwardly directed pocket over the edge of the panel.

The clips act to restrict upward movement of the panels while allowing limited downward movement.

The flooring is now secured with the panel members. The flooring is composed of 4' to 6' tongue and groove shorts which are about 1" thick and about 2" wide. Other lengths, widths and thicknesses may be used. The flooring is secured with the sub-flooring with nails, brads or other suitable materials.

It is paramount that the court direction be determined prior to installing the instant flooring system. The sub-floor panels must be installed to extend diagonally of the longitudinal or lengthwise direction of the court while the flooring shorts are installed parallel with the longitudinal direction of the court.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
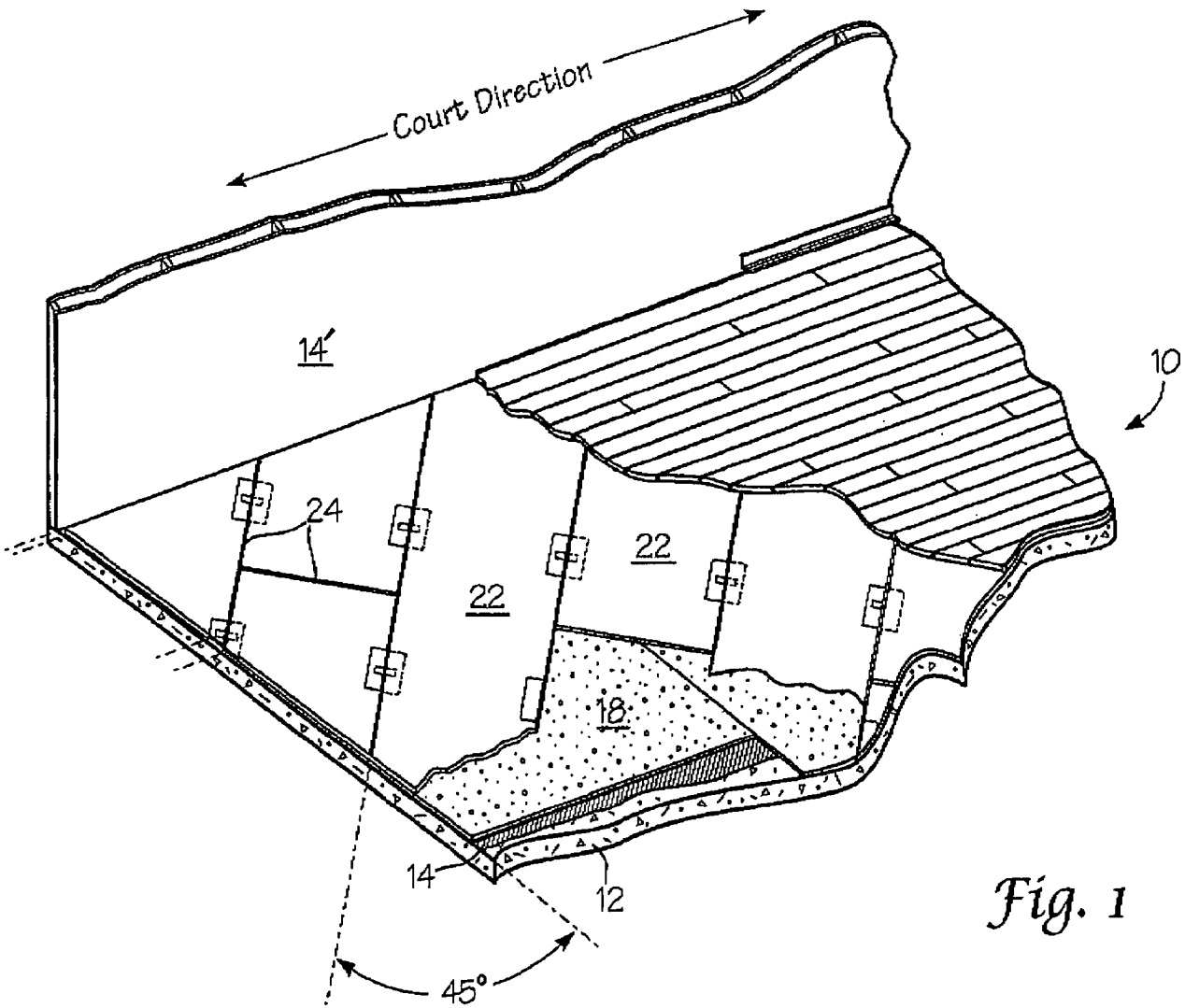
FIG. 1 is a sectional perspective view showing the resilient flooring system of the invention relative to a wall and to the base layer.

Turning now to FIG. 1, the flooring system as arranged to form an athletic court is shown at 10. As shown best in FIGS. 1 and 3, flooring system 10 is installed over a non-resilient base surface or layer 12 which is normally formed of concrete. Base 12 is generally of unitary construction extending uniformly over the area. A wall section identified as 14' is shown extending along one side of the base surface 12. In actuality, the wall would normally extend completely around the court area and include doors at selected locations as is normal. Also, normally there is provided a roof forming a normal enclosure utilized for athletic events.

As shown, base 12 presents a substantially smooth and level upper surface. In order to prevent moisture from passing through base 12 and into the resilient flooring system a vapor barrier 16 comprising synthetic sheets laid over the upper surface of base 12 is provided. Preferably, polyethylene sheets form the vapor barrier.

A resilient covering is placed over vapor barrier 14. The resilient covering comprises a ¼" to ½" thick foam or upper covering 18 comprised normally of 2'×2' pads laid 12" on center. The entire base layer and vapor barrier are covered with sub-floor 20.

The sub-floor 20 is comprised preferably of 2'×8' plywood panels 22 formed at ¾" thick. Plywood panels 22 are laid side by side and end to end over the entire floor area. It is desirable that a gap of about ¼", identified as 24, be left between both the adjacent side and end sections of each panel to allow for expansion.

In order to provide the flooring system with multi-directional stability, panels 24 are laid diagonally of the longitudinal direction of the court. The court direction is indicated in FIG. 1 by an arrow. The panels are also laid on 4' centers which means that end sections of panels adjacent an intermediate panel are located along the center line of the intermediate panel and along a single axis.

Figure 2:
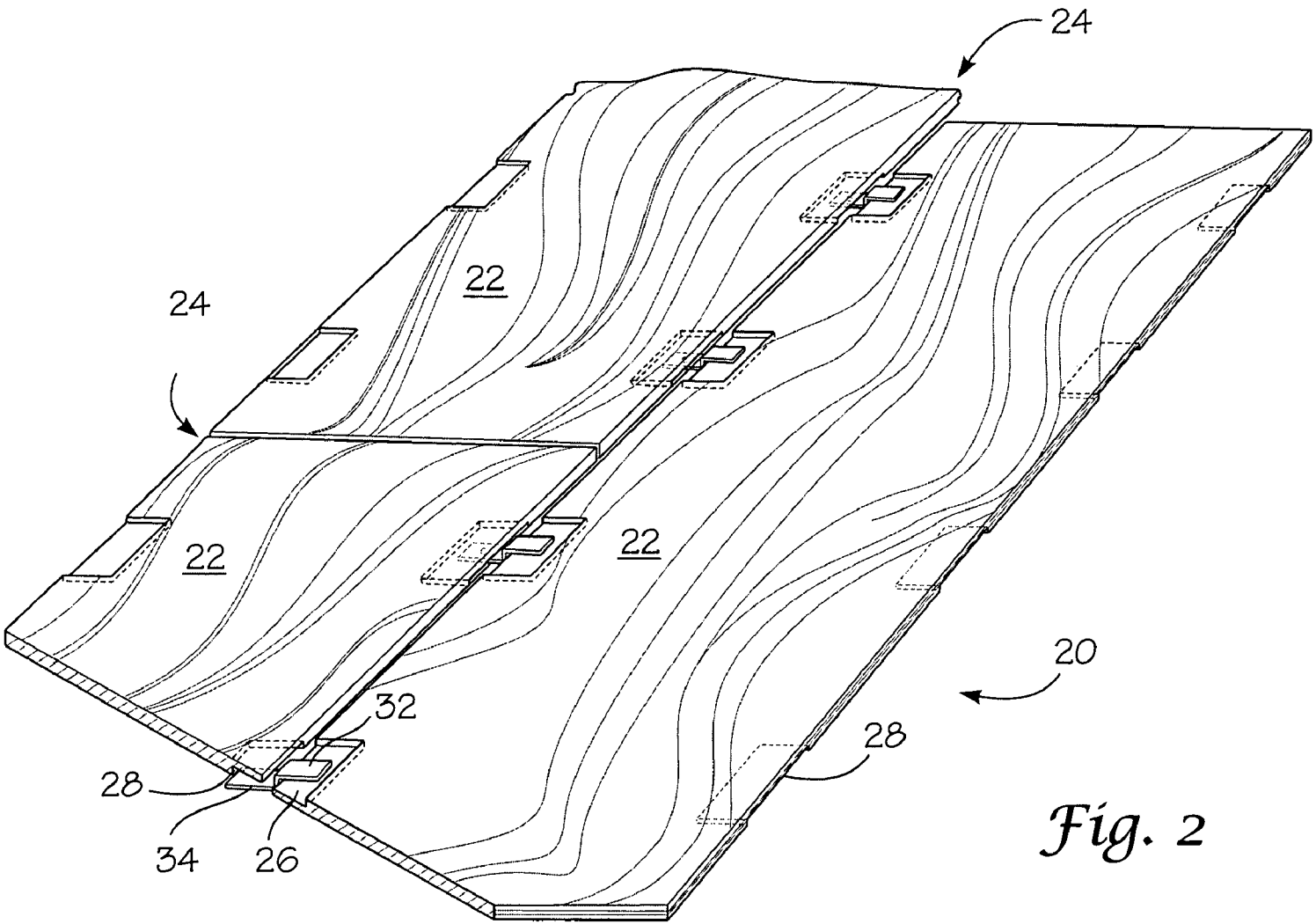
FIG. 2 is a sectional perspective view of sub-flooring panels as arranged in the resilient flooring system.

Each panel 22, as best shown in FIG. 2, has a plurality of upwardly directed pockets 26 formed at selected spaced intervals along a first edge. Along a second and opposed edge, each panel 22 has an equal number at like spaced intervals a plurality of downwardly directed pockets 28. Pockets 26 are preferably recessed below the upper surface of panels 22 by slightly more than one-half the thickness of the panel while pockets 28 are recessed upwardly above the lower surface of the panel by slightly less than one-half the panel width. Pockets 26 of a first panel are arranged in opposing positions of pockets 28 of an adjacent panel when the panels are in position over the resilient covering.

Beneath each pocket 28 a section which is about 2"×2" is cut out of the resilient layer 18 exposing vapor barrier 16 and base surface 12.

Figure 3:
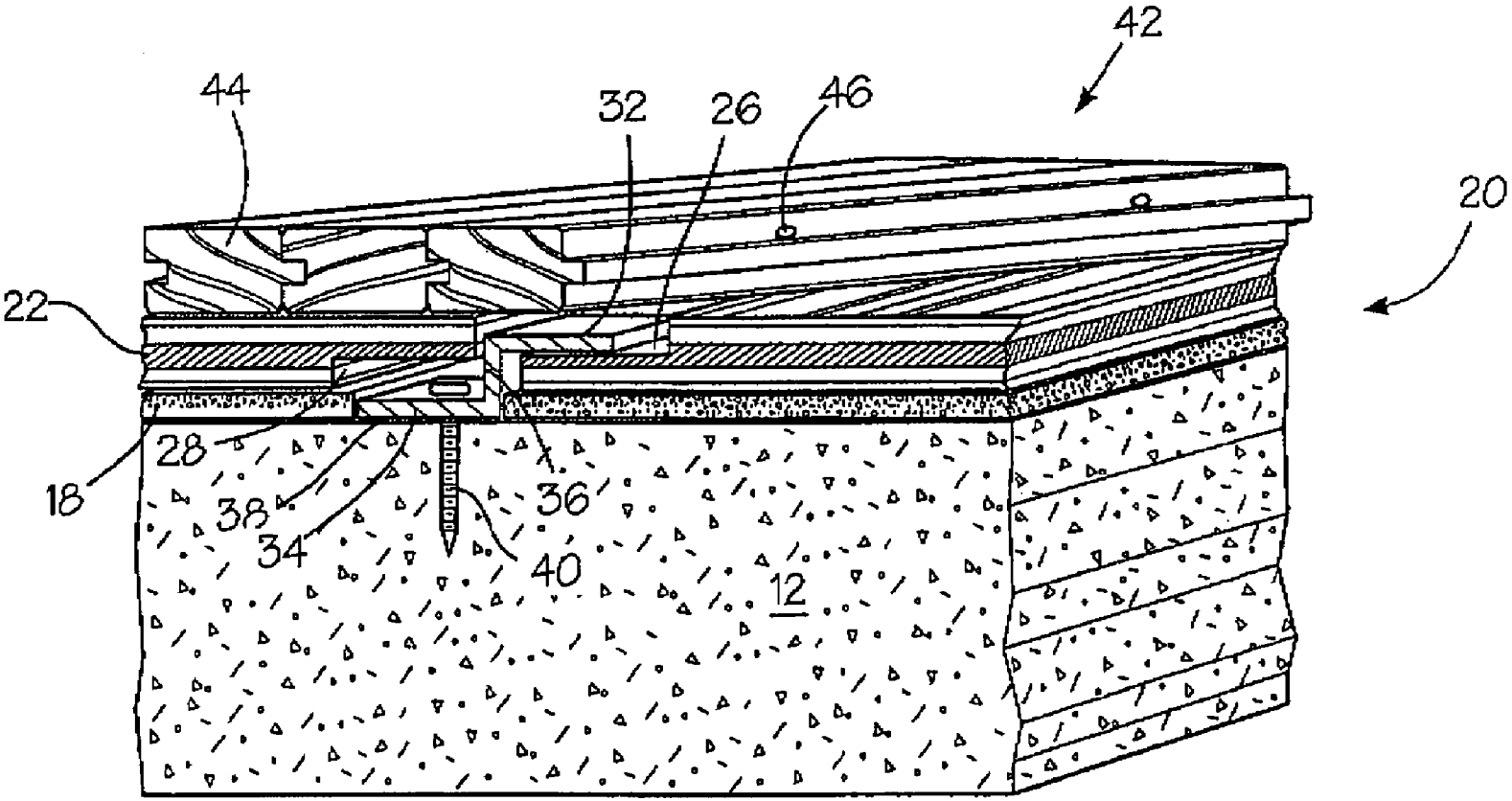
FIG. 3 is a cutaway side view of the layers comprising the resilient flooring of the invention

Metal Z-shaped clips 30, best shown in FIG. 3, are provided for stabilizing panels 22 in the positions in which they are placed. Clips 30 are preferably of 16 gauge steel and comprise an upper finger 32, a lower finger 34 separated by body 36. Fingers 32, 34 extend in parallel planes and are separated by body 36 which extends perpendicularly of the planes along which the fingers extend.

A clip 30 is positioned in each cutout 38 with lower finger 34 in engagement with vapor barrier 16 and base surface 12 or just the base surface. Body 36 is located adjacent the edge of a panel 22 with upper finger 32 extending into pocket 26 and over that portion of the panel forming the upwardly facing surface of the pocket. A securing member, usually a nail 40, secures clip 30 in position.

With clips 30 held in fixed position by nails to fingers 32 secure the edges panels 22 against upward vertical movement. Due to the compressive capabilities of resilient layer 18 panels 22 are allowed limited downward vertical movement.

Flooring 42, comprised of tongue and groove shorts 44, is secured to the sub-floor panels 22 by any of a variety of means such as nails 46. Shorts 44 preferably comprise 4' to 6' units which are about 1" thick and 2" wide. Shorts 44 are preferably formed of maple, however, other hardwoods are acceptable.

As earlier stated, shorts 44 are laid tongue and groove, on centers and arranged so that no ends meet over gaps 24. Nails, brads or staples may be used to secure the shorts with the sub-floor panels.

As earlier stated, shorts 44 are laid parallel with the court direction which is diagonally of panels 22 forming sub-floor 20. The shorts are secured with the panels across their width forming a unitary structure of the sub-floor 20 and the flooring 42. The structure provides for smooth and minimal vertical movement of flooring system 10 during use. The arrangements also provide a floor with uniform vertical resistance and a stable structure.

While a preferred embodiment of the invention has been described using specific terms, such description is for illustrative purposes only, and it is to be understood that changes and variations may be made without departing from the spirit or scope of the following claims.

What is claimed is:

1. A resilient flooring system for use in athletic facilities having a length-wise direction which extends parallel the direction of play and a widthwise direction which extends transverse the direction of play, said system comprising:

a non-resilient base surface;

a resilient layer extending over the base surface:

a sub-floor comprising panels laid over said resilient layer in side-by-side and end-to-end fashion, said panels extending diagonally of said lengthwise and crosswise directions;

a plurality of equally spaced recessed upwardly facing pockets formed in an upper edge and on one side of each said panel and a plurality recessed downwardly facing pockets formed in a lower edge and on an opposite side of each said panel, said upwardly facing and said downwardly facing pockets being aligned transverse of said panels;

clips, positioned to extend over said upwardly directed pockets and beneath said downwardly directed pockets, secured with said base floor, said clips allowing limited and controlled vertical movement of said panels;

flooring shorts laid in parallel over and secured with said panel members, said shorts extending parallel with said lengthwise direction and transverse of said widthwise direction;

securing members securing said flooring shorts with said panel members wherein;

said flooring is uniformly resilient.

2. The resilient flooring system of claim 1 wherein expansion joints are provided between said ends and said sides of said panels.

3. The resilient flooring system of claim 2 including cutouts in said resilient layer, said cutouts being located beneath said downwardly directed pockets to receive first ends of said clips.

4. The resilient flooring system of claim 1 wherein said resilient layer comprises foam pads at least ¼" thick laid in juxtaposed positions.

5. The resilient flooring system of claim 1 wherein said sub-floor panels comprise 2'×8'¾" plywood panels.

6. The resilient flooring system of claim 1 wherein there are four pockets per side of each of said panels.

7. The resilient flooring system of claim 1 wherein said clips are Z-shaped.

8. The resilient flooring system of claim 1 wherein said flooring shorts are tongue and groove, about 1" thick, about 2" wide and of varying lengths.

9. The resilient flooring system of claim 1 wherein said flooring shorts are secured with said sub-floor panels with one of nails, brads and staples.

10. The resilient flooring system of claim 1 wherein said flooring shorts are each secured with said sub-floor panels on opposing sides of grooves formed between said ends and sides of said panel.

11. A resilient flooring system in combination with an athletic court, said court having a playing direction and a cross-direction transverse of said playing direction;

said flooring system comprising a non-resilient base covered with a resilient layer;

a sub-flooring comprising substantially rectangular panel members having sides and ends, laid side-by-side and end-to-end in staggered relationship diagonally of said playing direction, said panels being spaced along said ends and said sides a slight distance forming expansion gaps;

flooring shorts positioned on said panel members forming said sub-floor in end-to-end and side-to-side engagement, said shorts being arranged to extend over said expansion gaps, parallel with said playing direction and diagonally of said panel members;

securing means securing said shorts with said panel members on opposing sides of said expansion gaps;

clips securing said panel members with said base flooring in a manner allowing limited vertical movement;

pockets formed in equally spaced positions in opposed first and second sides of each of said panels, said pockets in said first side facing downward and said pockets in said second side facing upwards, wherein;

said flooring system provides a resilient playing surface with no dead spots and with limited vertical movement.

12. The resilient flooring system of claim 11 wherein said panels are arranged with said first pockets of first ones of said panels aligning with said second pockets of adjacent ones of said panels, wherein; spaced pairs of said aligned pockets extend along the length of each of said adjacent of said panels.

13. A method of forming a resilient flooring system for an athletic court comprising:

providing an athletic court and determining the direction of play on said court;

providing said athletic court having a non-resilient base floor and covering said base floor with a resilient layer;

providing a plurality of panels each having upwardly and downwardly directed pockets along opposed sides and laying said panels diagonally of said direction of play in end-to-end and side-to-side relationship;

providing clip members with first and second parallel extensions and securing said clip members with said base floor with said first of said parallel extensions positioned beneath and in said downwardly directed pockets and said second of said parallel extensions extending above and in said upwardly directed pockets;

providing flooring members and arranging said flooring members to extend parallel with said direction of play and diagonal of said panels and securing said flooring members with said panels.

* * * * *